US010858297B1

(12) United States Patent
Krawietz et al.

(10) Patent No.: US 10,858,297 B1
(45) Date of Patent: Dec. 8, 2020

(54) METAL BINDERS FOR INSENSITIVE MUNITIONS

(71) Applicants: Thomas Krawietz, Shalimar, FL (US); Victor Bellitto, Alexandria, VA (US)

(72) Inventors: Thomas Krawietz, Shalimar, FL (US); Victor Bellitto, Alexandria, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 14/120,909

(22) Filed: Jul. 9, 2014

(51) Int. Cl.
*C06B 45/20* (2006.01)

(52) U.S. Cl.
CPC ..... *C06B 45/20* (2013.01)

(58) Field of Classification Search
CPC ..... C06B 45/20
See application file for complete search history.

(56) References Cited

U.S. PATENT DOCUMENTS 4,097,317 A 6/1978 Shnur et al.
4,168,191 A 9/1979 Benziger
H969 H 10/1991 Yee
5,411,615 A 5/1995 Sumrail et al.
5,447,104 A 9/1995 Lebet
5,567,912 A * 10/1996 Manning ..... C06B 21/0025 149/11
5,852,256 A 12/1998 Hornig
7,011,027 B2 3/2006 Reese et al.
7,736,582 B2 6/2010 Toth
8,075,715 B2 12/2011 Ashcroft et al.
8,123,879 B1 * 2/2012 Bellitto ..... C06B 45/12 149/108.2
8,168,016 B1 5/2012 Nicolich et al.
2010/0269723 A1 * 10/2010 Hugus ..... F42B 12/74 102/430

* cited by examiner

*Primary Examiner* — Aileen B Felton
(74) *Attorney, Agent, or Firm* — Fredric J. Zimmerman

(57) ABSTRACT

An explosive composition, an insensitive munition with a metal eutectic binder, and a method include using a metal eutectic binder with metal coated explosive particles. The metal eutectic binder concept represents novel melt-cast solid mixtures having explosives such as RDX (cyclonite) or HMX (octogen) distributed in an alloy including, for example, eutectic bismuth (Bi)/tin (Sn). Eutectic alloys are particularly considered to provide a melting point of the mixture below the exothermic point of the explosive so that vented munitions disarm by melting without exploding in the event of fire or other elevated heating. Particularly novel is the pre-coating of crystals of explosive (RDX/HMX) with a metal to promote wetting and bonding during melt fabrication of the final mixture. Copper, aluminum, and other metals are considered for use as coating.

13 Claims, 2 Drawing Sheets

METAL BINDERS FOR INSENSITIVE MUNITIONS

STATEMENT OF GOVERNMENT INTEREST

The present invention described herein may be manufactured and used by or for the Government of the United States of America for government purposes without the payment of any royalties thereon or therefore.

FIELD OF THE INVENTION

The present disclosure relates generally to insensitive munitions. More particularly, the present disclosure relates to metal binders for insensitive munitions used with pre-coated explosive material.

BACKGROUND OF THE INVENTION

Insensitive munitions are munitions that are chemically stable enough to withstand external shock, fire, impact by shrapnel without premature explosion. Insensitive munitions (IM) will react less violently (i.e. burn, decompose, or have no reaction) rather than explode when subjected to external stimuli such as slow and fast heating (cook-off), bullet impact, fragment impact, sympathetic reaction, or shaped charge jet impact. Exemplary IMs may include warheads, bombs, rocket motors, and the like. In normal castable explosives, the bulk modulus of the binder is sufficiently lower than that of the entrained solids. As a result, any imposed load results in a larger compression of the binder than the solids. This characteristic results in net movement of solids relative to one another, possibly contacting adjacent particles, and may cause the binder to delaminate from the surface of the solids.

BRIEF SUMMARY OF THE INVENTION

In an exemplary embodiment, an explosive composition includes explosive and/or oxidizer containing composition particles including a metal coating thereon; filler particles; and a metal binder containing particles of the explosive and/or oxidizer containing composition, and the filler particles together to form a cohesive whole. The metal coating is applied to the explosive and/or oxidizer containing composition particles prior to inclusion in the metal eutectic binder thereby providing a metal interface to the explosive and/or oxidizer containing composition particles for wetting of the metal binder in a molten state and adherence thereto once solidified. The metal binder can include a mixture of eutectic bismuth (Bi) and tin (Sn). The metal binder may include a trace amount of indium (In). The metal binder can include at least 50% wt. of eutectic bismuth (Bi). The metal binder may include about 58% wt. of eutectic bismuth (Bi) and about 42% wt. of tin (Sn). The metal binder may also include a trace amount of indium (In). The explosive and/or oxidizer containing composition particles can include one of RDX and HMX. The metal coating may include one of copper (Cu) and aluminum (Al) or other metals or alloys. Optionally, the explosive and/or oxidizer containing composition particles may include one of RDX and HMX; the metal coating can include one of copper (Cu) and aluminum (Al); and the metal binder may include a mixture of eutectic bismuth (Bi) and tin (Sn).

In another exemplary embodiment, an insensitive munition with a metal binder, includes a melt-cast metal binder system incorporating crystalline explosive and/or oxidizer solids. The melt-cast metal binder system includes a first metal and a second metal; and wherein the crystalline explosive and/or oxidizer solids include a metal coating applied to the crystalline explosive and/or oxidizer solids prior to inclusion in the melt-cast metal binder system thereby providing a metal interface to the crystalline explosive and/or oxidizer solids for wetting of the melt-cast metal binder system in a molten state and adherence thereto once solidified. The first metal can include at least 50% wt. bismuth (Bi) and the second metal can include tin (Sn). The insensitive munition with a metal binder can further include a third metal including a trace amount of indium (In). The first metal can include about 58% wt. of eutectic bismuth (Bi) and the second metal can include about 42% wt. of tin (Sn). The crystalline explosive and/or oxidizer solids can include one of RDX and HMX. The metal coating can include one of copper (Cu) and aluminum (Al) or other metals or alloys.

In yet another exemplary embodiment, a method includes pre-coating crystalline explosive and/or oxidizer solids including one of RDX and HMX with a metal coating; providing the pre-coated crystalline explosive and/or oxidizer solids in a melt-cast metal binder system in a molten state; and cooling the melt-cast metal eutectic binder system with the pre-coating providing a metal interface to the crystalline explosive and/or oxidizer solids for wetting of the melt-cast metal in the molten state and adherence thereto once solidified.

BRIEF DESCRIPTION OF THE DRAWINGS

The present disclosure is illustrated and described herein with reference to the various drawings, in which like reference numbers are used to denote like system components/method steps, as appropriate, and in which.

DETAILED DESCRIPTION OF THE INVENTION

In various exemplary embodiments, metal eutectic binders for insensitive munitions are described. The metal eutectic binder concept represents novel melt-cast solid mixtures having explosives such as RDX (cyclonite) or HMX (octogen) distributed in an alloy including, for example, eutectic bismuth (Bi)/tin (Sn). The solid mixture is stable against, for example, sympathetic reaction, fragment/bullet impact, shape charge jet impact, and other events that may cause unwanted discharge or separation of the mixture. Structural stability is enhanced by a raised bulk modulus (resistance to compression) of the mixture relative to the explosive. Eutectic alloys are particularly considered to provide a melting point of the mixture below the exothermic point of the explosive so that vented munitions disarm by melting without exploding in the event of fire or other elevated heating. Particularly novel is the pre-coating of crystals of explosive (RDX/HMX) with a metal to promote wetting and bonding during melt fabrication of the final mixture. Copper, aluminum, and other metals are considered for use as coating. Previous investigations lacked such pre-coatings and thus adequate bonding was not achieved. The Bi/Sn alloy system, with possibly small amounts of indium (In), are considered in order to controllably raise the mixture melting point by ratio selection above a previously investigated In/Bi/Sn alloy.

Figure 1:
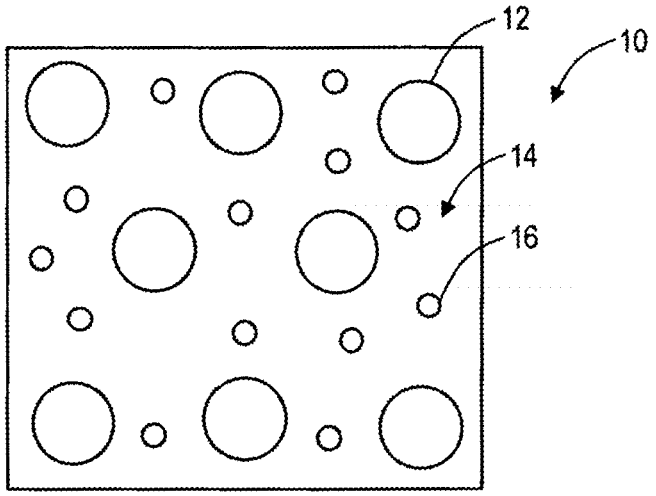
FIG. 1 (Prior Art)
FIG. 1 is a cross-sectional diagram of a conventional composite explosive with an explosive material, a binder, and filler particles.

Referring to FIG. 1, in a conventional embodiment, a cross-sectional diagram illustrates a conventional composite explosive 10. The conventional composite explosive 10 includes explosive material 12, a binder 14, and filler particles 16. The explosive material 12 may include RDX, HMX, or the like. The filler particles 16 are included to lower the consumption of the more expensive binder material or to better some properties of the mixture material. The binder 14 is any material or substance that holds or draws the explosive material 12 and the filler particles 16 together to form a cohesive whole. In normal castable explosives such as the conventional composite explosive 10, the bulk modulus of the binder 14 is sufficiently lower than that of the entrained solids, i.e. the explosive material 12. Bulk modulus is a measure of a substance's resistance to uniform compression. Thus, any imposed load results in a larger compression of the binder 14 than the solids 12, 16. This characteristic leads to the net movement of solids 12, 16 relative to one another, possibly contacting adjacent particles, and may cause the binder 14 to delaminate from the surface of the solids 12, 16. During impact, either into hard and deeply buried targets or with high speed fragments or bullets, energetic particulates may contact one another due to non-uniform compression of the particulate composite explosive.

Figure 2:
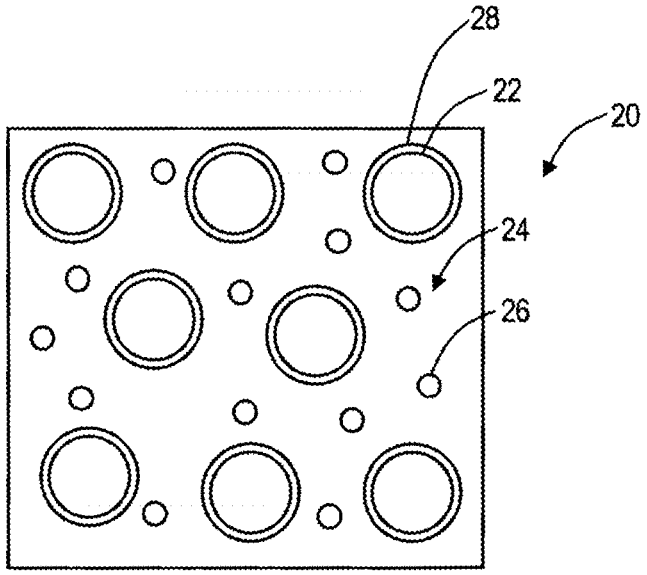
FIG. 2 is a cross-sectional diagram of a metal alloy composite explosive with an explosive material, a binder, and filler particles.

Referring to FIG. 2, in an exemplary embodiment, a cross-sectional diagram illustrates a metal alloy composite explosive 20. The metal alloy composite explosive 20 includes particles of explosive material 22, a binder 24, and filler particles 26. Additionally, the metal alloy composite explosive 20 includes a metal coating 28 of the explosive material 22. The metal coating 28 is included in the explosive material 22 as a pre-coating to promote wetting and bonding during melt fabrication of the final mixture. In an exemplary embodiment, the metal coating 28 may include copper (Cu), aluminum (Al), or other metals including metal alloys or layers of different metals. In an exemplary embodiment, the metal coating 28 around the explosive material and/or oxidizer material 22, is in a range of about 0.01 microns to about 1,000 microns (0.01-1,000 microns), and more particularly, the metal coating 28 is a one (1) micron layer of RDX. The binder 24 may be a eutectic metal binder. Further, and although not limited to a specific theory, the interaction between the metal coating 28 and the metal binder 24 is potentially metal to metal bonding. In addition, in an exemplary embodiment, the particles of explosive material 22 may include RDX, HMX, or other explosive materials and/or oxidizer particles. In an exemplary embodiment, the particles of explosive material and/or oxidizer materials are in a range of about 1 micron to about 10,000 microns (1-10,000 microns), and more particularly, in a range of about 100-about 500 microns (100-500 microns). Simple mixing of RDX and HMX in a eutectic metal binder has been performed previously and without success due to the differences in surface tension and lack of adhesion between the metal and the organic explosive. It has been demonstrated that uniform mixing of RDX in an In/Bi/Sn eutectic melting at 81° C./178° C. may be achieved by pre-coating the explosive material 22 of RDX with the metal coating 28 of metallic copper.

The metal alloy composite explosive 20 is an explosive with a melt-cast metal eutectic binder system incorporating crystalline explosive solids and this alloy could dramatically reduce shock sensitivity and reactions associated with compression of the explosive fill. Increasing the bulk modulus of the binder 24 decreases or eliminates the particle-particle contact during compression by causing the binder 24 to support a majority of the imposed load. Due to the decreased forces present on the energetic components and decreased particle-particle interaction, this technology greatly reduces enhance survivability towards sympathetic reaction, fragment impact, bullet impact and shaped charge jet impact.

The bulk modulus of various energetic material components and some representative metals are provided in Table 1.

TABLE 1

Bulk Modulus of Possible Explosive Constituents [A, B]

| Component | Bulk Modulus (GPa) |
|---|---|
| RDX | 13.0 |
| HMX | 13.6 |
| TNT | 2.92 |
| HTPB | 1.4 |
| Parrafin | 3.52 |
| Bismuth | 31 |
| Tin | 58 |

For example with respect to the conventional composite explosive 10, assume a Hydroxyl-terminated polybutadiene (HTPB)/HMX explosive system with HTPB being the binder 14 and HMX being the explosive material 12. In the case of the HTPB/HMX explosive system, the HTPB compresses 9.7 times more than the HMX crystals during loading. Now, for example with respect to the metal alloy composite explosive 20, assume a 58 wt % Bi/42 wt % Sn eutectic which is estimated to have a bulk modulus of approximately 40 GPa and compress 0.34 as much as the HMX (which includes the metal coating 28). The entrapped crystals see only 34% of the applied load as they can be compressed much more easily, and simply need to be compressed enough to fit the new, reduced volume under the applied loading.

Figure 3:
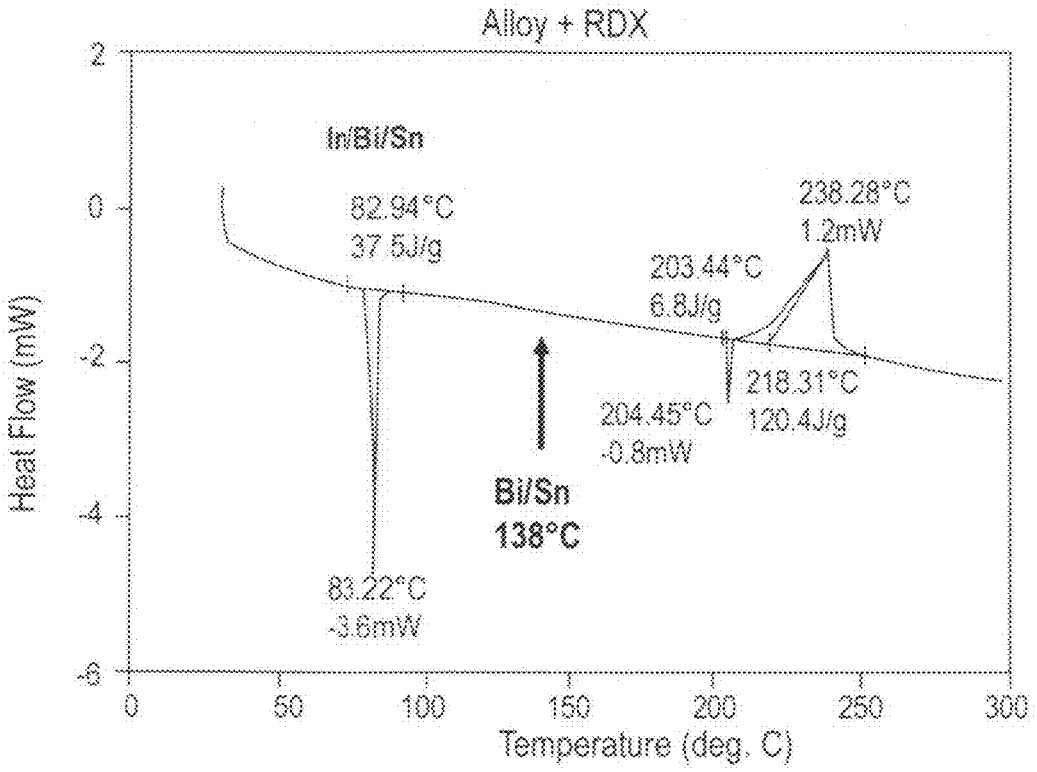
FIG. 3 is a graph of a differential scanning calorimetry (DSC) for the metal alloy composite explosive of FIG. 2.
Figure 4:
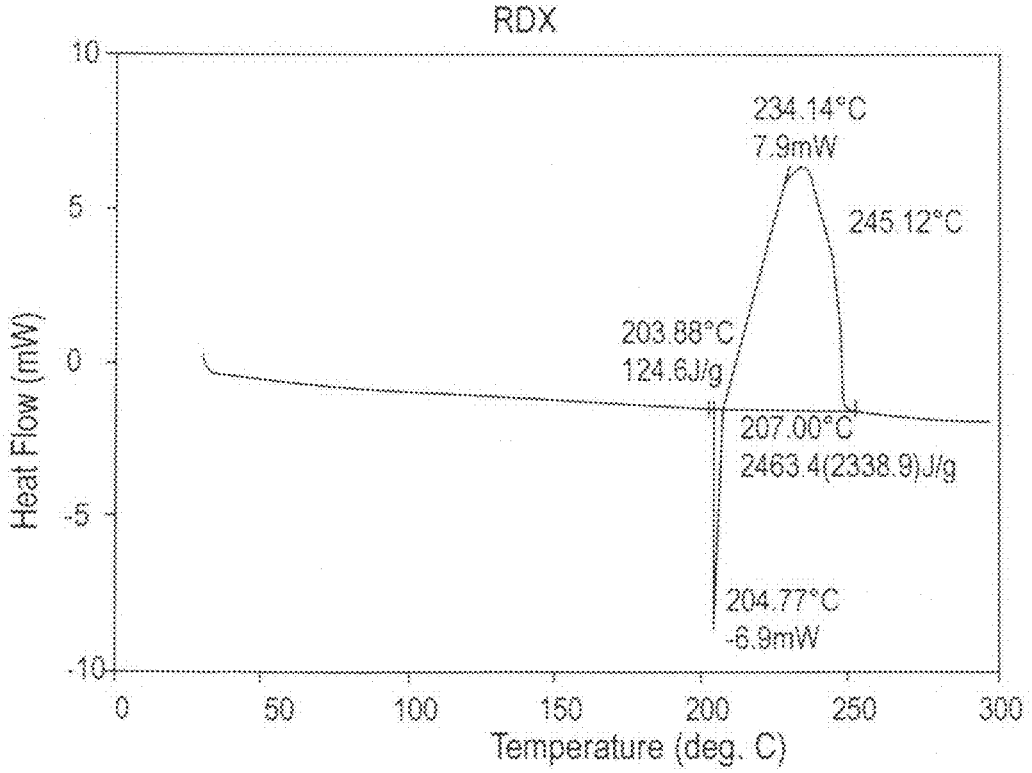
FIG. 4 is a graph of a differential scanning calorimetry (DSC) for the conventional composite explosive of FIG. 1.

Referring to FIGS. 3 and 4, in an exemplary embodiment, differential scanning calorimetry (DSC) comparisons are shown for the metal alloy composite explosive 20 (FIG. 3) versus the conventional composite explosive 10 (FIG. 4). The DSC gives information about thermal stability, melting, decomposition, etc. Specifically, FIG. 3 illustrates the metal alloy composite explosive 20 with a In/Bi/Sn binder. As noted in FIG. 3, the early melt temperature of the binder would fit into the venting strategies being considered for improvements in fast and slow cook-off reactions. Early melt onset of the binder before the melt-to-exotherm reaction of the energetic allows for the material to leave the confinement of the weapon system. It is possible to tailor the melt temperature of the binder matrix through the metal alloy. The inclusion of bismuth in the eutectic binder is important as bismuth is unique in reducing or eliminating volume shrinkage upon solidification, with about 50% Bi being required in most systems to have zero volume change.

In an exemplary embodiment, the eutectic binder of the metal alloy composite explosive 20 includes 50% wt. to 65% wt. Bi and 35% wt. to 50% wt. Sn which keeps the final melt temperature to between around 150-160 deg. C. Extending the aforementioned ranges will increase the melt temperature higher and therefore is unrealistic to employ. Optionally, trace amounts of indium (In), are considered in order to raise, controllably, the mixture melting point by ratio selection above a previously investigated In/Bi/Sn alloy. In an exemplary embodiment, the eutectic binder of the metal alloy composite explosive 20 includes 58% wt. Bi and 42% wt. with optional trace amounts of In. A 58 wt % Bi/42 wt % Sn eutectic is estimated to have a bulk modulus of ~40 GPa which is much higher than the 1.4 GPa of HTPB. Increasing the bulk modulus of the binder would decrease or eliminate the particle-particle contact during compression by causing the binder to support a majority of the imposed load. An explosive including a melt-cast metal eutectic binder system incorporating crystalline explosive solids could dramatically reduce shock sensitivity and reactions associated with compression. Early melt on-set (tailorable) of the metal binder would fit into the current venting strategies being considered for improvements in fast and slow cook-off reactions.

In addition to the eutectic binder, the metal alloy composite explosive 20 includes the metal coating 28, which can include copper (Cu), aluminum (Al), or other metals including metal alloys or layers of different metals. As described herein, simple mixing of RDX and HMX in a metal has been performed previously without success due to the differences in surface tension and lack of bonding between the metal and the organic explosive. To overcome these aforementioned limitations, the metal alloy composite explosive 20 utilizes a process of first coating the energetic particles (i.e., the explosive material 22) with the metal coating 28 that allows for the wetting of molten eutectic binder and adherence once solidified.

Although the present disclosure has been illustrated and described herein with reference to exemplary embodiments and specific examples thereof, it will be readily apparent to those of ordinary skill in the art that other embodiments and examples may perform similar functions and/or achieve like results. All such equivalent embodiments and examples are within the spirit and scope of the present disclosure, are contemplated thereby, and are intended to be covered by the following claims.

Finally, any numerical parameters set forth in the specification and attached claims are approximations (for example, by using the term "about") that may vary depending upon the desired properties sought to be obtained by the present invention. At the very least, and not as an attempt to limit the application of the doctrine of equivalents to the scope of the claims, each numerical parameter should at least be construed in light of the number of significant digits and by applying ordinary rounding.

What is claimed is:

1. An explosive composition, consisting of:

particles of at least one of an explosive and an oxidizer containing composition comprising a metal coating thereon;

filler particles; and a metal binder containing the particles of at least one of the explosive and the oxidizer containing composition, and the filler particles together to form a cohesive whole, wherein the metal coating is applied to the particles of at least one of the explosive and the oxidizer containing composition prior to inclusion in the metal eutectic binder thereby by providing a metal interface to the particles of at least one of the explosive and the oxidizer containing composition for wetting of the metal binder in a molten state and adherence thereto once solidified, wherein the metal coating is situated around said at least one of said explosive and said oxidizer containing composition where the metal coating is chemically bonded to said at least one of the explosive and the oxidizer, wherein said at least one of the explosive and the oxidizer is encapsulated by the metal coating, wherein the metal binder comprises a mixture of an eutectic alloy, which is situated around the said at least one of the explosive and the oxidizer encapsulated by the metal coating so that the metal coating is situated intermediate the metal binder and said one of the explosive and the oxidizer, and wherein the eutectic alloy includes a melting temperature less than an exothermic point of said one of the explosive and the oxidizer.

2. The explosive composition of claim 1, wherein the metal binder comprises a mixture of eutectic bismuth (Bi) and tin (Sn).

3. The explosive composition of claim 2, wherein the metal binder comprises a trace amount of indium (In).

4. The explosive composition of claim 2, wherein the metal binder comprises at least 50% wt. of eutectic bismuth (Bi).

5. The explosive composition of claim 2, where in the metal binder comprises about 58% wt. of eutectic bismuth (Bi) and about 42% wt. of tin (Sn).

6. The explosive composition of claim 2, wherein the metal binder comprises about 58% wt. of eutectic bismuth (Bi) and about 42% wt. of tin (Sn), and wherein the metal binder comprises a trace amount of indium (In).

7. The explosive composition of claim 1, wherein the particles of at least one of the explosive and the oxidizer containing composition comprise one of RDX and HMX.

8. The explosive composition of claim 7, wherein the metal coating comprises one of copper (Cu) and aluminum (Al).

9. The explosive composition of claim 1, wherein the particles of at least one of the explosive and the oxidizer containing composition comprise one of RDX and HMX, wherein the metal coating comprises one of copper (Cu), aluminum (Al), and other metals, and wherein the metal binder comprises a mixture of eutectic bismuth (Bi) and tin (Sn).

10. The explosive composition of claim 9, wherein the metal binder comprises at least 50% wt. of eutectic bismuth (Bi).

11. The explosive composition of claim 9, wherein the metal binder comprises about 58% wt. of eutectic bismuth (Bi) and about 42% wt. of tin (Sn).

12. The explosive composition of claim 9, wherein the metal binder comprises about 5$% wt. of eutectic bismuth (Bi) and about 42% wt. of tin (Sn), and wherein the metal binder comprises a trace amount of indium (In).

13. The explosive composition of claim 1, wherein the particles of at least one of the explosive and the oxidizer containing composition comprise RDX, wherein the metal coating comprises tin (Sn), and wherein the metal binder comprises a mixture of eutectic bismuth (Bi), tin (Sn) and indium (In).

* * * * *